US007543814B2

(12) United States Patent
Qi et al.

(10) Patent No.: US 7,543,814 B2
(45) Date of Patent: Jun. 9, 2009

(54) AUTOMATIC PAPER FEEDING APPARATUS

(75) Inventors: Zhien Qi, GuangDong (CN); Qianqiu Jin, HuBei (CN); Mingyong Wang, GuangDong (CN)

(73) Assignee: Lite-On Technology Corporation (TW)

( * ) Notice: Subject to any disclaimer, the term of this patent is extended or adjusted under 35 U.S.C. 154(b) by 0 days.

(21) Appl. No.: 12/078,594

(22) Filed: Apr. 2, 2008

(65) Prior Publication Data

US 2009/0001656 A1 Jan. 1, 2009

(30) Foreign Application Priority Data

Jun. 28, 2007 (TW) ..... 96123607 A

(51) Int. Cl.
*B65H 3/34* (2006.01)
*B65H 3/52* (2006.01)

(52) U.S. Cl. ..... 271/167; 271/121; 271/124

(58) Field of Classification Search ..... 271/128, 271/113, 114, 119, 121, 124, 125, 167
See application file for complete search history.

(56) References Cited

U.S. PATENT DOCUMENTS 4,305,577 A * 12/1981 Clay et al. ..... 271/119
4,437,658 A * 3/1984 Olson ..... 271/125
4,966,360 A * 10/1990 Pawlowski ..... 271/272
6,102,388 A * 8/2000 Thornhill ..... 271/119
7,165,765 B2 * 1/2007 Sonoda et al. ..... 271/122
2004/0251592 A1 * 12/2004 Ruhe et al. ..... 271/109

FOREIGN PATENT DOCUMENTS

JP 60262746 * 12/1985
JP 03088648 * 4/1991
JP 07215512 * 8/1995
TW I280222 5/2007

* cited by examiner

*Primary Examiner*—Patrick H Mackey
*Assistant Examiner*—Patrick Cicchino
(74) *Attorney, Agent, or Firm*—Bacon & Thomas, PLLC

(57) ABSTRACT

An automatic paper feeding apparatus used in an electronic apparatus including a tray frame, a tray body, a paper-taking roller, at least a wiggling device and a frictional roller is provided. The tray body can move into and out from the tray frame. The paper-taking roller moves the top paper by rotating along a rotating direction. The wiggling device wiggles toward the paper-taking roller from an initial position. When the paper-taking roller moves the top paper, the frictional roller faces the paper-taking roller and contacts the top paper by the same frictional surface. When the tray body moves out the tray frame, the frictional roller rotates and causes the other frictional surface of the frictional roller to face the paper-taking roller substantially. When the tray body moves into the tray frame, the wiggling device wiggles toward the paper-taking roller from the initial position and wiggles back to the initial position.

9 Claims, 10 Drawing Sheets

AUTOMATIC PAPER FEEDING APPARATUS

This application claims the benefit of Republic of Taiwan application Serial No. 096123607, filed Jun. 28, 2007, the subject matter of which is incorporated herein by reference.

BACKGROUND OF THE INVENTION

1. Field of the Invention

The invention relates in general to an automatic paper feeding apparatus, and more particularly to an automatic paper feeding apparatus whose frictional roller has several frictional surfaces.

2. Description of the Related Art

Currently, printer, copier or multi-functional machine normally achieves automatic paper feeding by an automatic paper feeding apparatus 100 as indicated in FIG. 1. The automatic paper feeding apparatus 100 is used in a printer. When the printer receives a printing instruction, the automatic paper feeding apparatus 100 mainly moves a top paper P contained in a paper carrying plate 130 by the paper-taking roller 110. The paper-taking roller 110 is designed to take the topmost sheet of paper. However, as the frictional coefficients between different varieties of paper are different, the design cannot cover a full range of variety. Therefore, a frictional plate 120 is needed for feeding the paper. When the paper-taking roller 110 moves the top paper P, only the topmost top paper P will enter the paper track 140 situated in the left side for subsequent printing, avoiding the occurrence of paper jam. An elastic member Sp is used for adjusting the distance between the frictional plate 120 and the paper-taking roller 110.

To assure that each time only one sheet of top paper P is sequentially fed into the paper track 140. The frictional coefficients between the paper-taking roller 110, the frictional plate 120 and the top paper P satisfy the expression: $u1>u3>u2$, wherein u1 is the frictional coefficient between the surface of the paper-taking roller 110 and the top paper P, u3 is the frictional coefficient between the frictional plate 120 and top paper P, u2 is the frictional coefficient between two sheets of top paper P.

However, the frictional plate 120, contacting paper and wearing out gradually, has an average printing capacity of 50,000 sheets of paper. After that, the user has to contact the supplier to replace the frictional plate. Therefore, there is a need for larger printing volume. For example, a laser printer has a printing volume of more than 100,000 sheets of paper.

SUMMARY OF THE INVENTION

The invention is directed to an automatic paper feeding apparatus which increases printing volume by the design of the frictional roller having several frictional surfaces. By moving out the paper tray for replenishing paper, the user can rotate the frictional roller to different frictional surfaces for the automatic paper feeding apparatus to proceed with subsequent processing of separating and sending paper. The automatic paper feeding apparatus can achieve high printing volume with a simple structure without incurring additional cost.

According to a first aspect of the present invention, an automatic paper feeding apparatus used in an electronic apparatus is provided. The automatic paper feeding apparatus includes a tray frame, a tray body, a paper-taking roller, at least a wiggling device and a frictional roller. The tray body used for containing sheets of paper can move into and out from the tray frame. The paper-taking roller disposed on the tray frame moves the top paper by rotating along a rotating direction. The wiggling device disposed on the tray frame wiggles toward the paper-taking roller from an initial position. The frictional roller disposed on the tray body has a plurality of frictional surfaces and contacting portions. When the tray body lies within the tray frame, the frictional roller is located between the wiggling device and the paper-taking roller. When the paper-taking roller moves the top paper, one of the contacting portions of the frictional roller, in the direction from the paper-taking roller to the wiggling device, leans against the wiggling device situated at the initial position, such that the frictional roller faces the paper-taking roller and contacts the top paper by the same frictional surface. When the tray body moves out the tray frame, the wiggling device situated at the initial position moves the contacting portion in the direction from the wiggling device to the paper-taking roller such that the frictional roller rotates and causes the other frictional surface of the frictional roller to face the paper-taking roller substantially. When the tray body moves into the tray frame, the wiggling device contacting the other contacting portion of the frictional roller wiggles toward the paper-taking roller from the initial position and wiggles back to the initial position until the other frictional surface is close with the paper-taking roller.

The invention will become apparent from the following detailed description of the preferred but non-limiting embodiments. The following description is made with reference to the accompanying drawings.

DETAILED DESCRIPTION OF THE INVENTION

Figure 1:
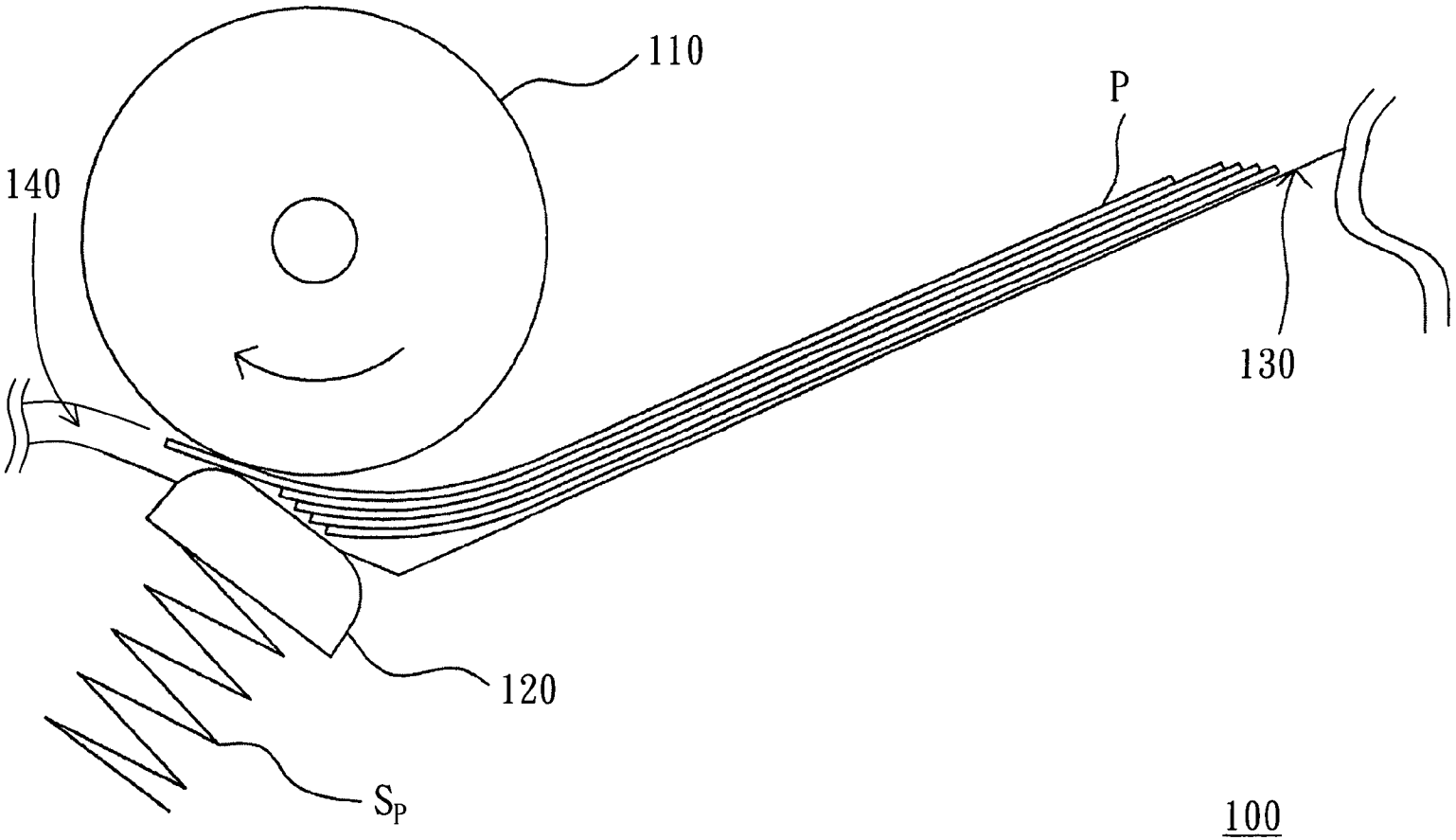
FIG. 1(PRIOR ART)
FIG. 1 (Prior Art) is a perspective of a conventional automatic paper feeding apparatus.
Figure 2:
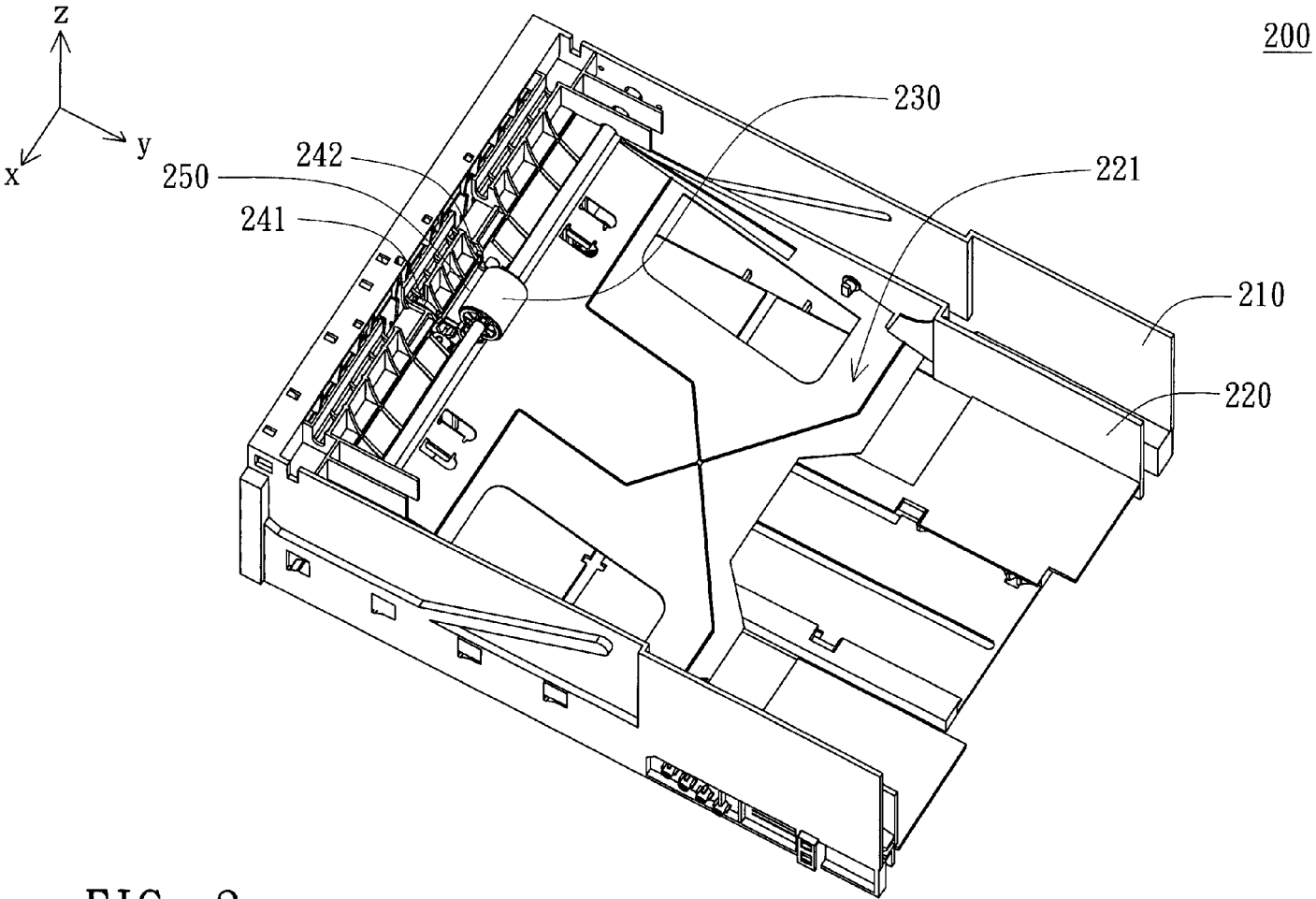
FIG. 2 is an exterior perspective of an automatic paper feeding apparatus according to a preferred embodiment of the invention.

Referring to FIG. 2, an exterior perspective of an automatic paper feeding apparatus according to a preferred embodiment of the invention is shown. The automatic paper feeding apparatus 200 can be used in an electronic apparatus such as printer, facsimile machine, scanner or copier that grabs paper for further processing. The automatic paper feeding apparatus 200 includes a tray frame 210, a tray body 220, a paper-taking roller 230, two wiggling devices 241 and 242 and a frictional roller 250, wherein the paper-taking roller 230 and the two wiggling devices 241 and 242 are disposed on the tray frame 210, and the frictional roller 250 is disposed on the tray body 220. The tray body 220 of FIG. 2 lies within the tray frame 210 and can move out the tray frame 210 along the −y direction of FIG. 2. After the user loads a number of sheets of top paper on the paper carrying plate 221 of the tray body 220, the tray body 220 is moved into the tray frame 210 along the +y direction.

As for how the mechanism between two wiggling devices 241 and 242 of the paper-taking roller 230 and the frictional roller 250 enable the frictional roller 250 and the paper-taking roller 230 to achieve the function of sending and separating paper and enable the tray body 220 to switch different frictional surfaces when moving into and out the tray frame 210 is disclosed below with accompanied drawings.

Figure 3A:
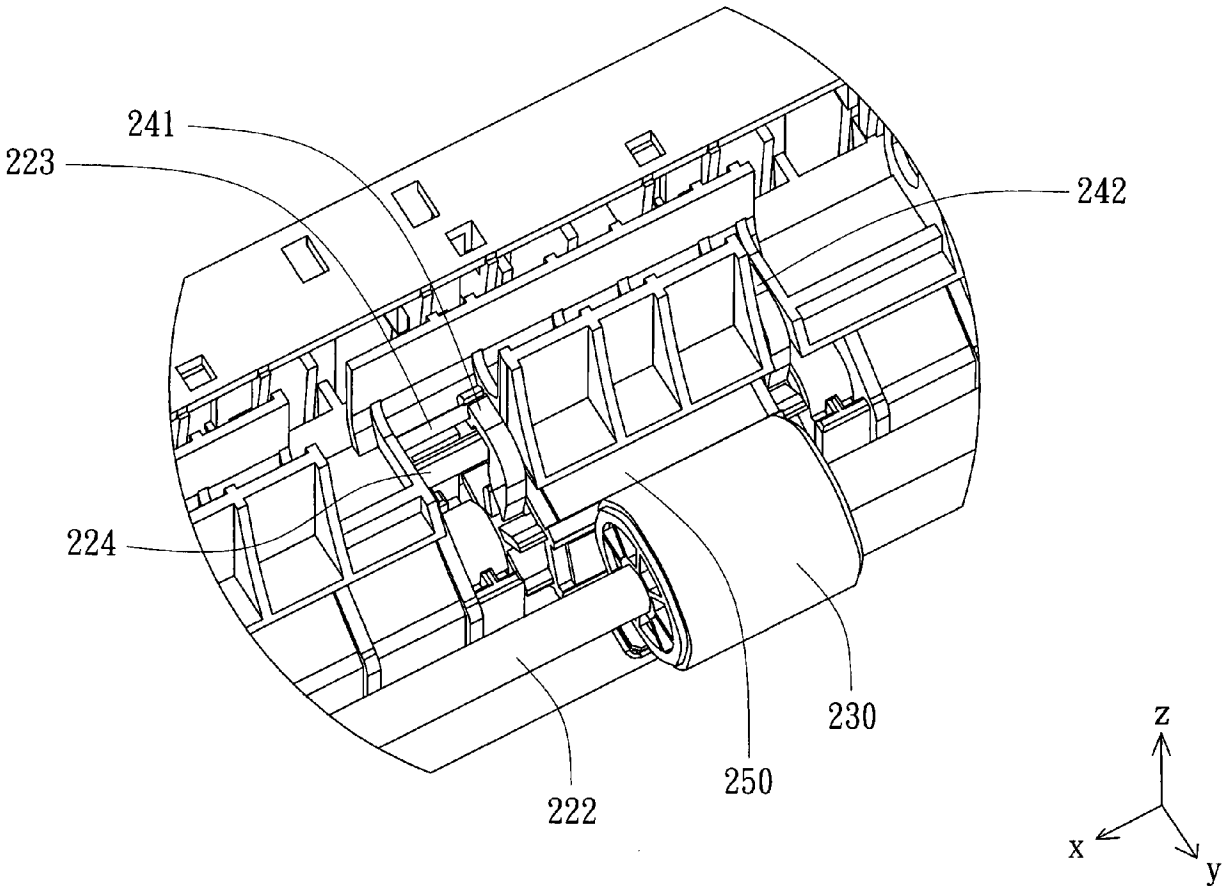
FIGS. 3A and 3B are two partial perspective of an automatic paper feeding apparatus 200 of FIG. 2.
Figure 3B:
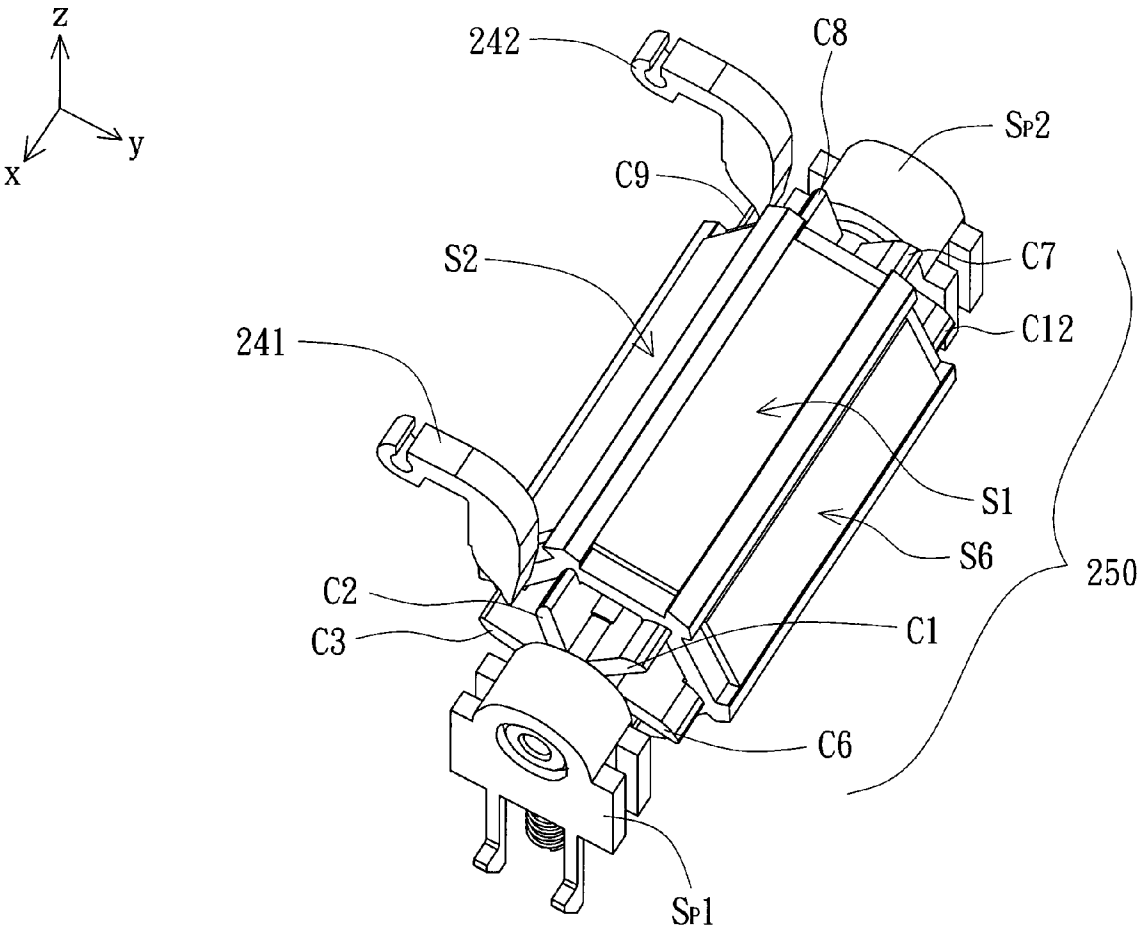
Figure 3C:
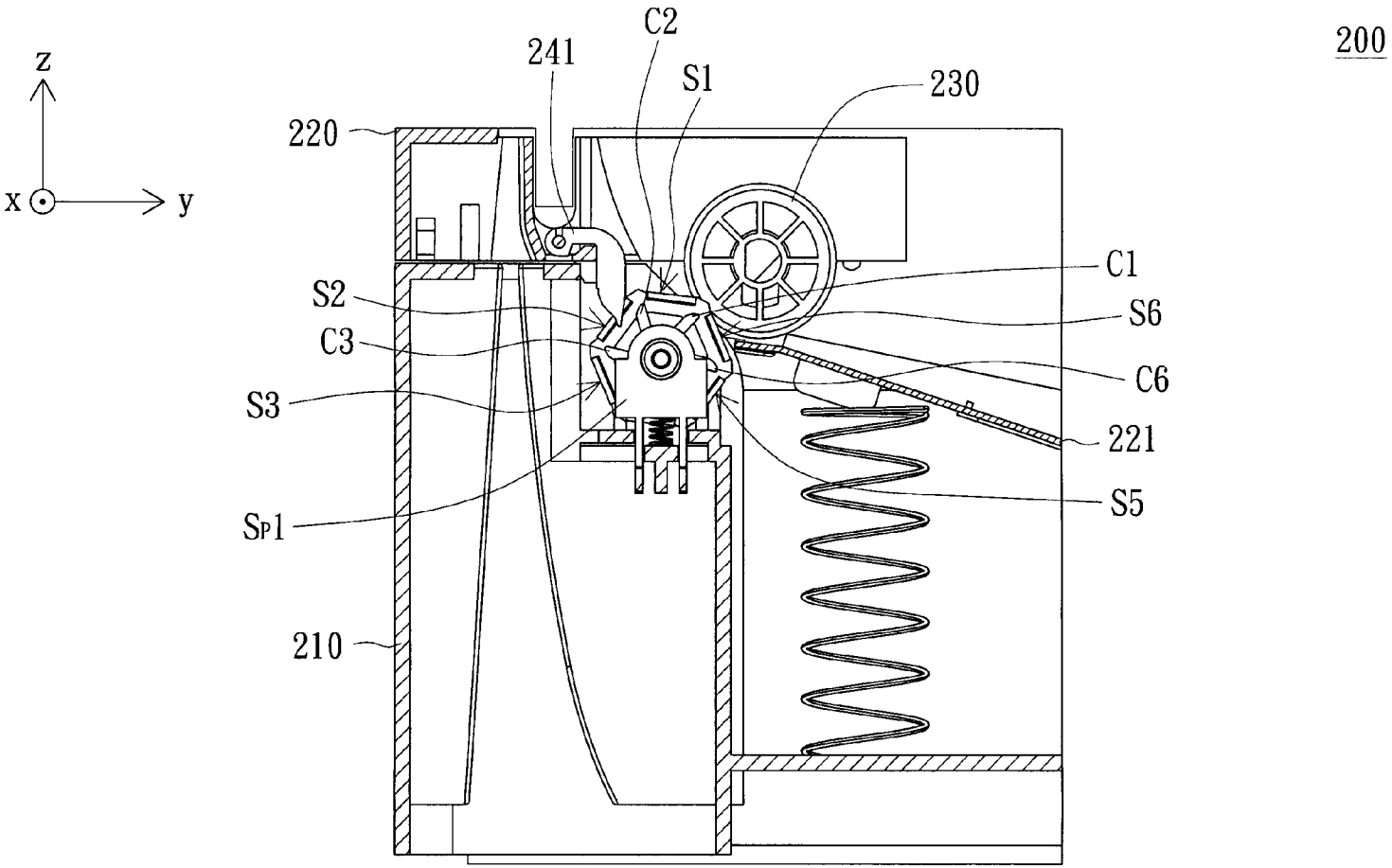
FIG. 3C is a lateral view of FIG. 2.

Referring to FIGS. 3A~3C. FIGS. 3A and 3B are two partial perspective of an automatic paper feeding apparatus 200 of FIG. 2. FIG. 3C is a lateral view of FIG. 2. As indicated in FIG. 3A, the paper-taking roller 230 is disposed on a bearing rod 222 of the tray frame 210. When the automatic paper feeding apparatus 200 receives an instruction, the automatic paper feeding apparatus 200 drives the bearing rod 222 and enables the paper-taking roller 230 to rotate along a clockwise direction of FIG. 3C so as to move the top paper (not illustrated) contacting the paper carrying plate 221 to move along an −y direction and enter the paper feeding area above the junction between the paper-taking roller 230 and the wiggling devices 241 and 242.

Furthermore, in the present embodiment of the invention, as indicated in FIG. 3A, one end of the wiggling device 241 is pivotally disposed above the bearing rod 223 of the tray frame 210, and the other bearing rod 224 of the tray frame 210 corresponds to the central bending of the wiggling device 241 for limiting the wiggling range of the wiggling device 241, such that the other end of the wiggling device 241 can wiggle toward the paper-taking roller 230 (along the anti-clockwise direction of FIG. 3C) from an initial position when the central bending leans against the bearing rod 224. The mechanism of the wiggling device 242 is the same with that of the wiggling device 241 and is not repeated here.

In the present embodiment of the invention, the automatic paper feeding apparatus 200 further includes two elastic members Sp1 and Sp2 disposed on the tray body 220, and the frictional roller 250 is pivotally connected between the two elastic members Sp1 and Sp2 (referring to FIG. 3B). The frictional roller 250 is a hexagonal cylinder having six frictional surfaces S1~S6 and a plurality of contacting portions C11~C12. The frictional surfaces S1~S6 respectively correspond to six lateral surfaces of a cylinder. Normally, a frictional plate can be adhered on the lateral surface to form a frictional surface. The contacting portions C1~C6 and C7~C12 are respectively located on two bottom surfaces (the y-z plane) of the cylinder, and each contacting portion corresponds to the junction between two lateral surfaces (or two frictional surfaces) and form a symmetric distribution. For example, the contacting portion C1 corresponds to the junction between the frictional surfaces S1 and S6. Moreover, as indicated in FIG. 3B, the two wiggling devices 241 and 242 respectively correspond to two bottom surfaces. For example, the wiggling device 241 and the contacting portion C1~C6 are on the same y-z plane.

Preferably, the frictional coefficient between the surface of the paper-taking roller 230 and the top paper is larger than that between each of the frictional surfaces S1~S6 and the top paper, and the frictional coefficient between each of the frictional surfaces S1~S6 and the top paper is larger than that between two sheets of top paper.

Figure 4:
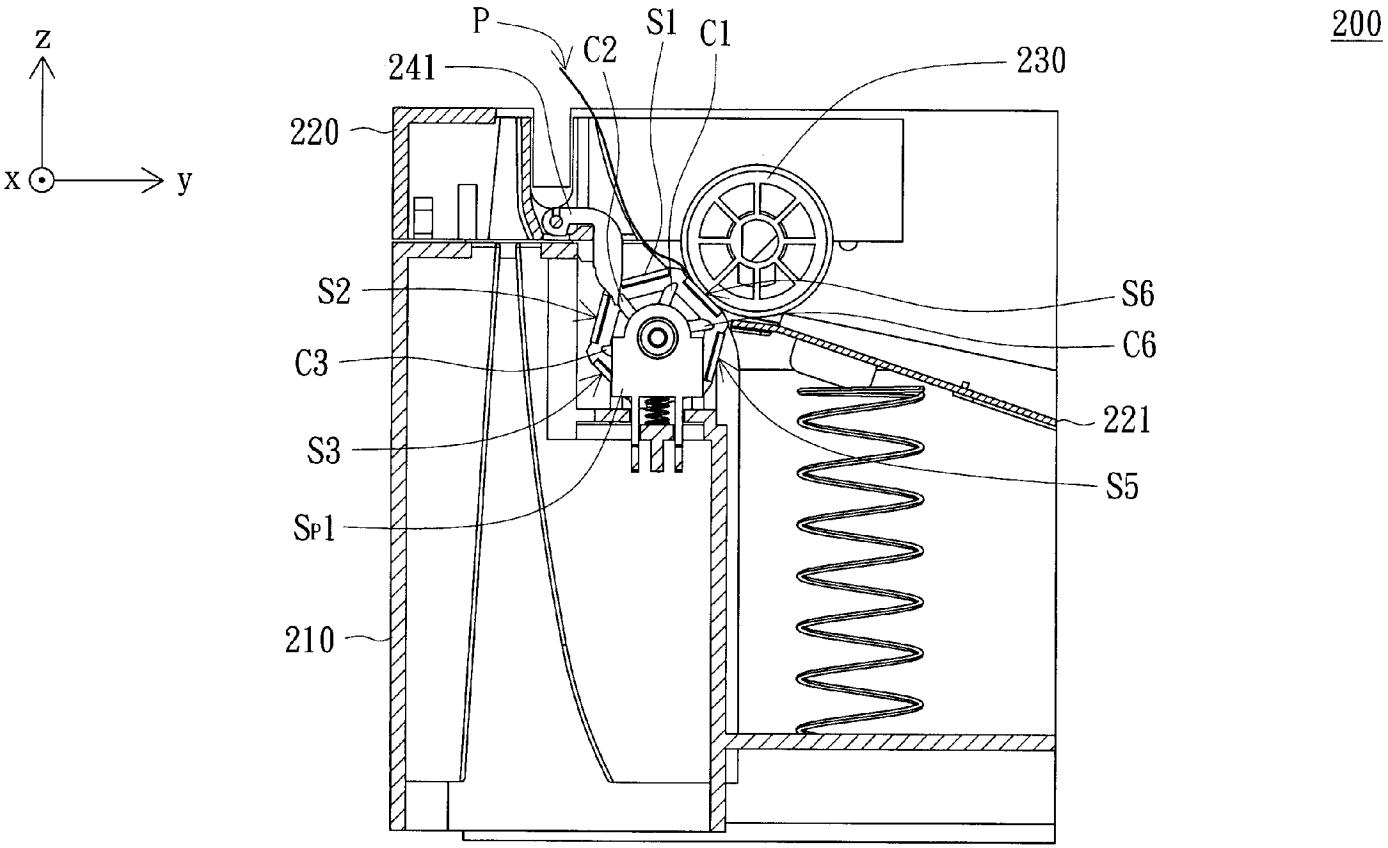
FIG. 4 is a perspective of the automatic paper feeding apparatus 200 feeding the paper.

Referring to FIG. 4, a perspective of the automatic paper feeding apparatus 200 separating the paper is shown. As indicated in FIG. 3C, when the tray body 220 lies within the tray frame 210, the frictional roller 250 is located between the wiggling device 241 (242) and the paper-taking roller 230, the frictional surface S6 substantially faces the paper-taking roller 230, and the other end of the wiggling device 241 is substantially located between the contacting portions C2 and C3 and is separated from the contacting portion C2 at a certain distance.

As indicated in FIG. 4, after the automatic paper feeding apparatus 200 starts to feed the paper, the paper-taking roller 230 rotates clockwise and moves the top paper P to the paper-feeding area by a frictional force. The frictional roller 250 being adjusted by two elastic members Sp1 and Sp2 keeps a suitable distance from the paper-taking roller 230 for tightly contacting the top paper P and separating the paper together with the paper-taking roller 230 according to the above design of frictional coefficients. Meanwhile, the frictional roller 250 contacts the top paper P due to the frictional surface S6 and receives an anti-clockwise force, such that the contacting portion C2 leans against the wiggling device situated at the other end of the initial position 241 in the direction (the −y direction) of FIG. 3C from the paper-taking roller 230 to the wiggling device 241 (242) as indicated in FIG. 4. The situation for the wiggling device 242 and the contacting portion C7~C12 are the same and is not repeated here.

As the wiggling device 241 can only wiggle toward the paper-taking roller 230 from the initial position, the frictional roller 250 also contacts the wiggling device 241 and receives a clockwise force due to the contacting portion C2. Thus, the frictional roller 250 maintains a balance state and faces the paper-taking roller 230 by a frictional surface S6 and contacts the top paper P.

Figure 5A:
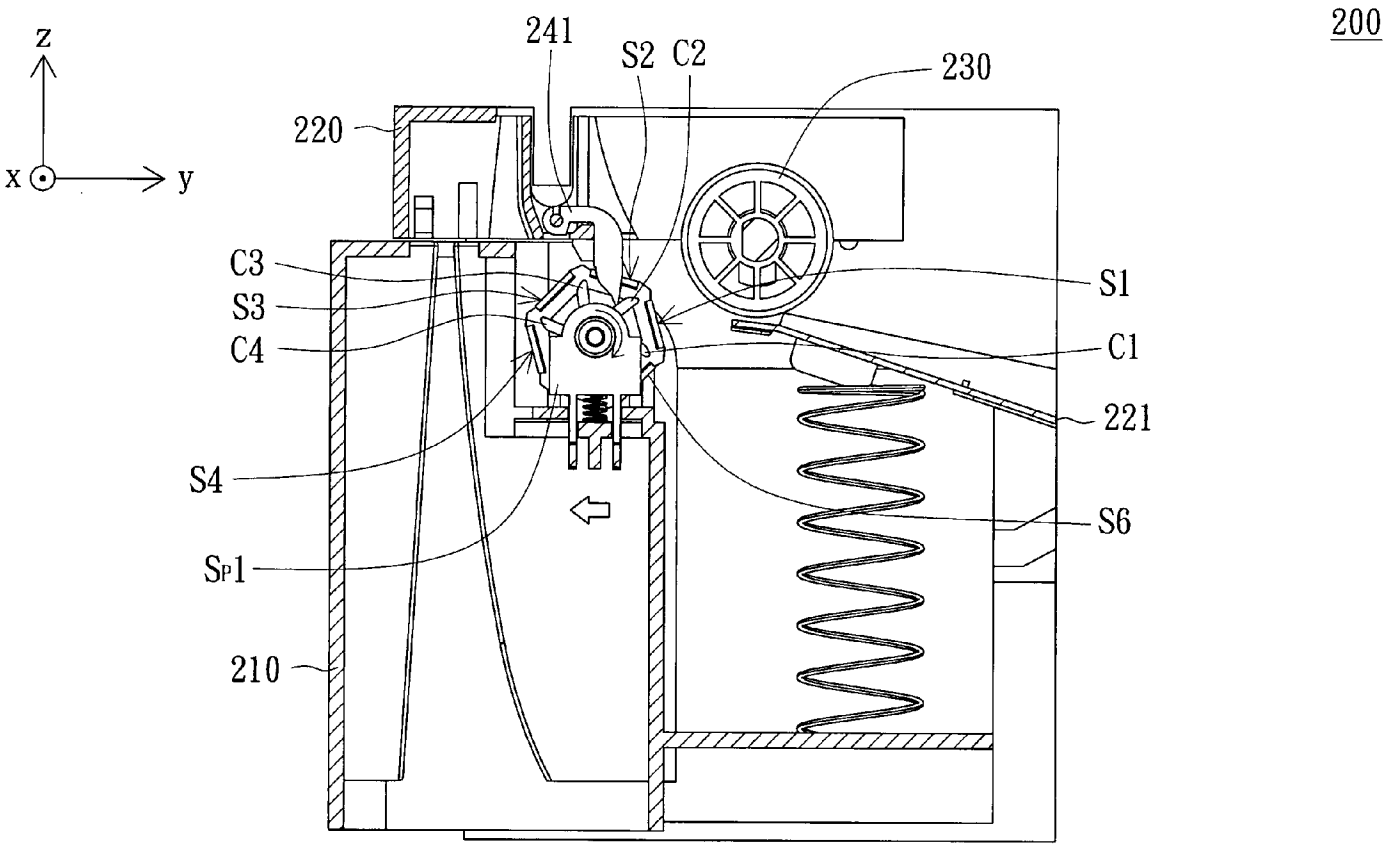
FIGS. 5A and 5B are two perspectives of a tray body 220 of the automatic paper feeding apparatus 200 moving out the tray frame 210.
Figure 5B:
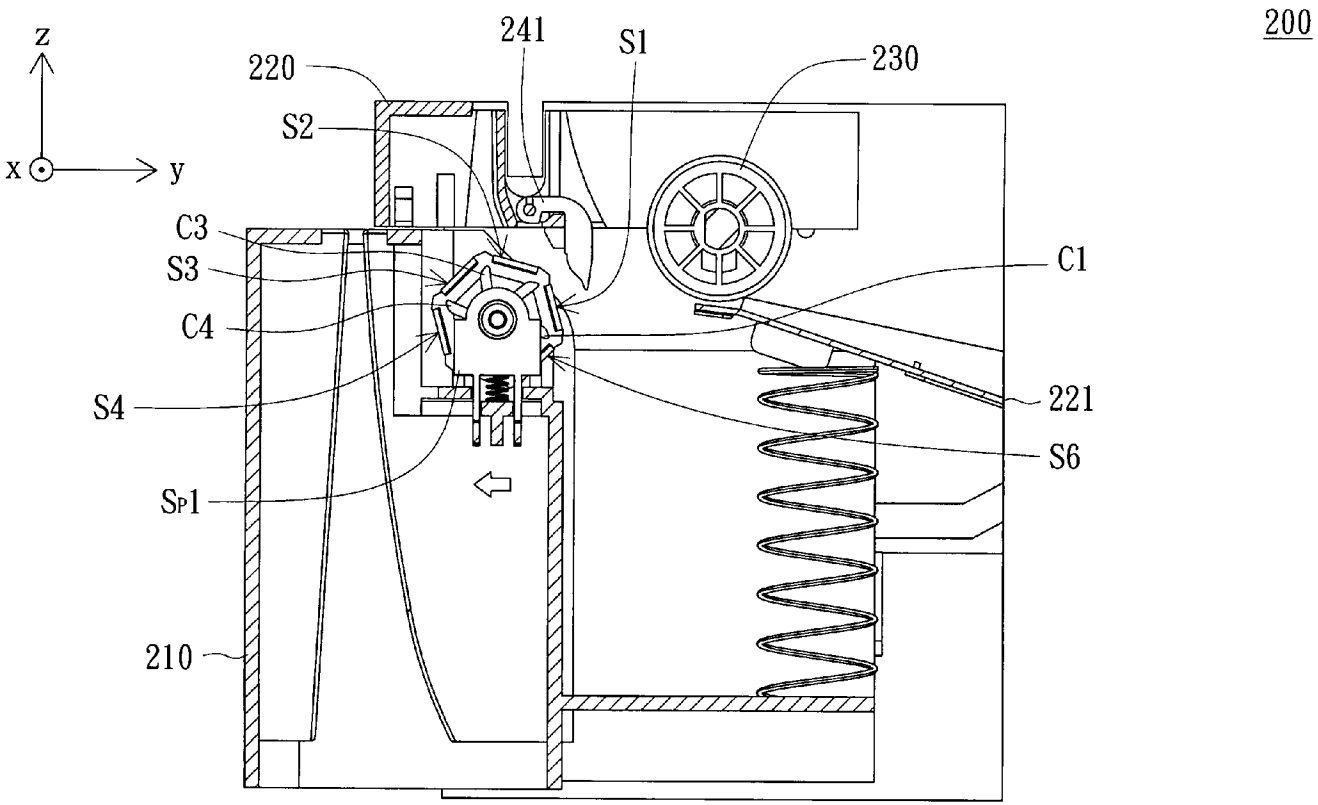

Referring to FIGS. 5A and 5B, two perspectives of a tray body 220 of the automatic paper feeding apparatus 200 moving out the tray frame 210 are shown. As indicated in FIG. 5A, when the tray body 220 starts to move out the tray frame 210 along the −y direction from the position of FIG. 4. The wiggling device 241 can only wiggles toward the paper-taking roller 230 from the initial position and can not wiggle toward the −y direction. Therefore, when the tray body 220 moves along the −y direction, the wiggling device situated at the initial position 241 also moves the contacting portion C2 and makes the frictional roller 250 rotate clockwise. As indicated in FIG. 5B, after the tray body 220 has moved a certain distance, the other end of the wiggling device 241 no longer contacts the contacting portion C2. After the frictional roller 250 rotates an angle, the frictional surface S1 substantially faces the paper-taking roller 230.

Figure 6A:
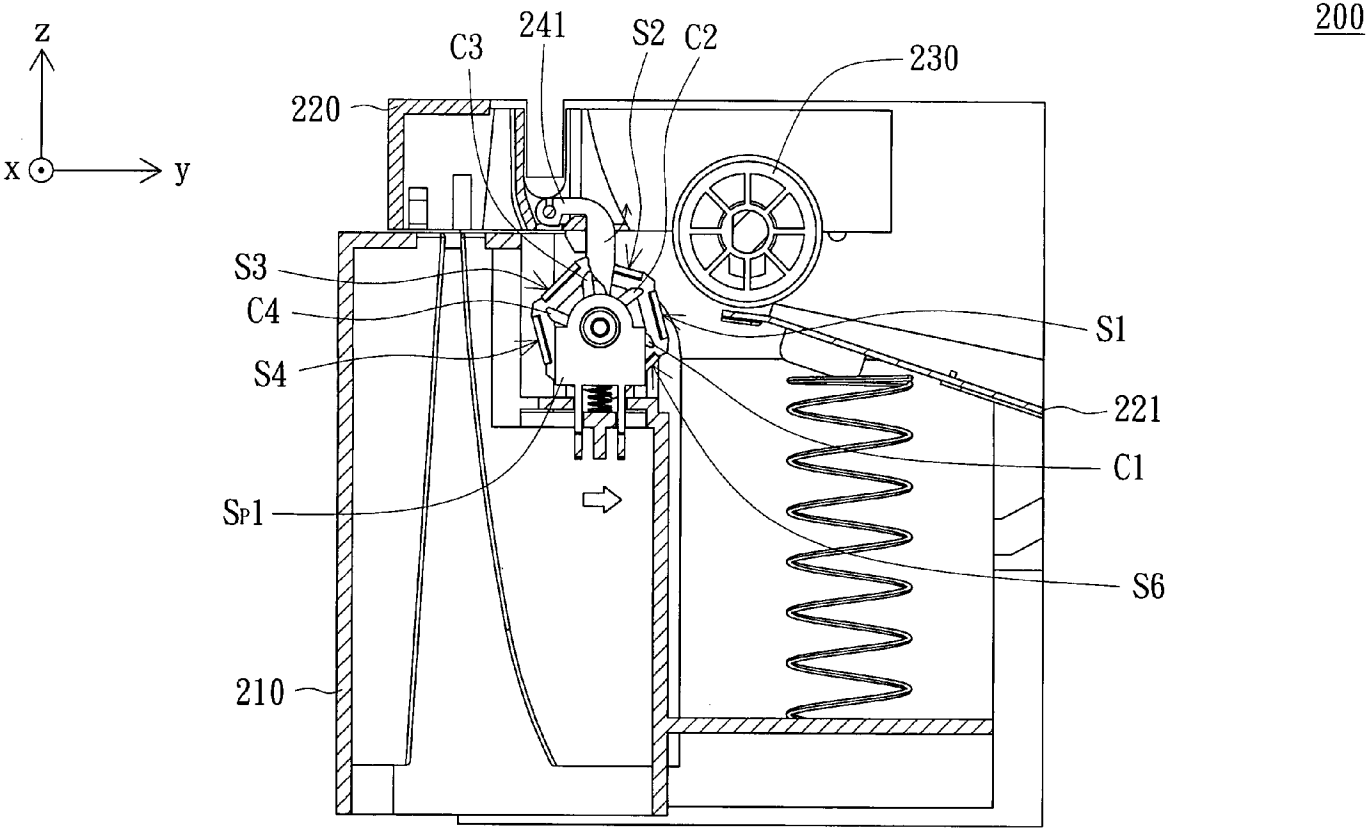
FIGS. 6A and 6B are two perspectives of a tray body 220 of the automatic paper feeding apparatus 200 moving into the tray frame 210.
Figure 6B:
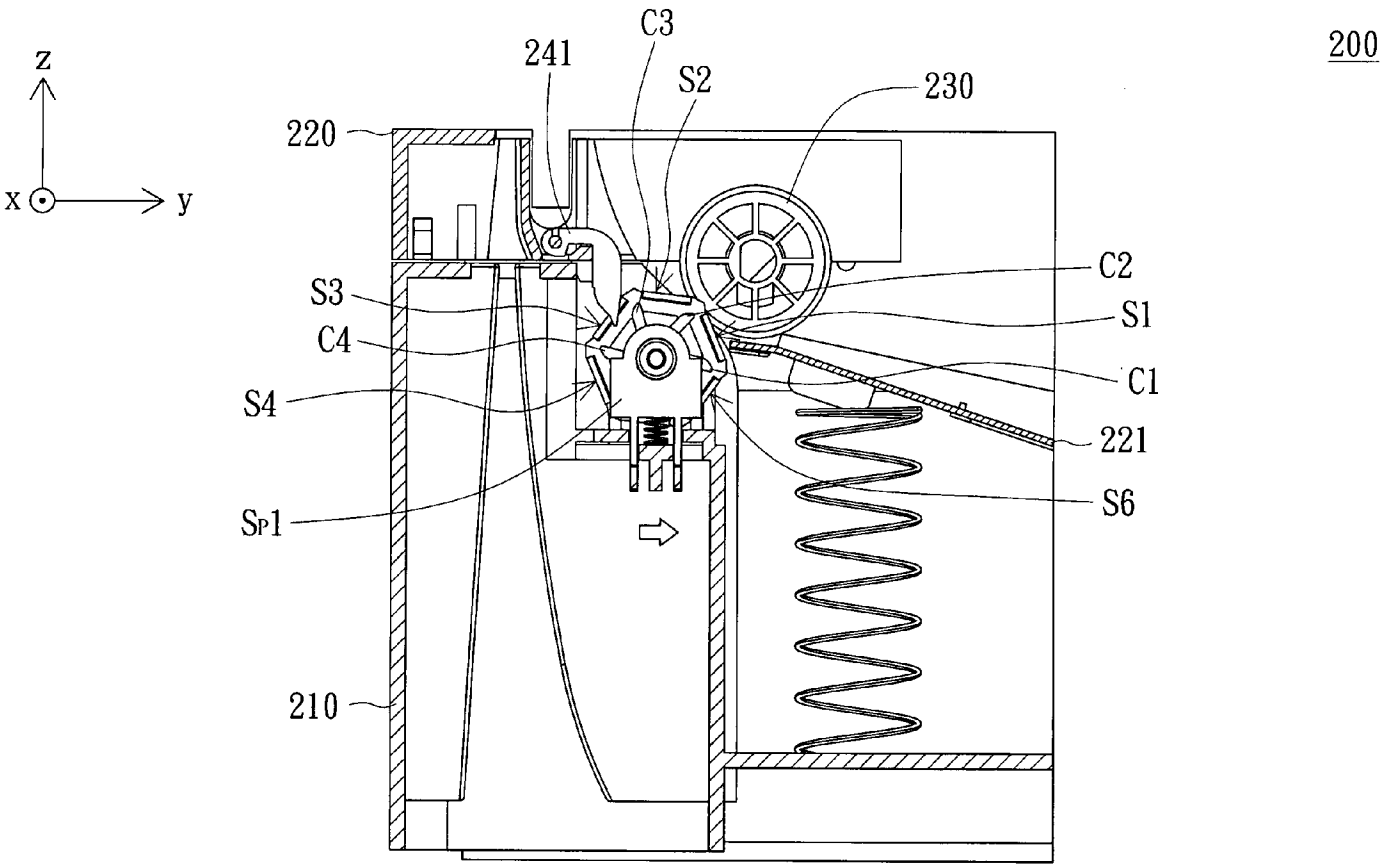

Referring to FIGS. 6A and 6B, two perspectives of a tray body 220 of the automatic paper feeding apparatus 200 moving into the tray frame 210 are shown. As indicated in FIG. 6A, the tray body 220 moves into the tray frame 210 from the position of FIG. 5B along the +y direction. The wiggling device 241 can wiggle toward the paper-taking roller 230 from the initial position. With suitable pivotal design (for example, the rotating intensity of the frictional roller 250 is greater than the wiggling intensity of the wiggling device 241), during the course when the tray body 220 continues to move in the +y direction from the position of FIG. 6A, the other end of the wiggling device 241 will be functioned by the contacting portion C3 or the contacting portion C2 and wiggle toward the paper-taking roller from the initial position 230 until the frictional surface S1 is close with the paper-taking roller 230 as indicated in FIG. 6B. The other end of the wiggling device 241, no longer contacting the contacting portion C3, wiggles back to the initial position and shows the same state as in FIG. 3C. Meanwhile, the other end of the wiggling device 241 substantially fall between the contacting portion C3 and C4 and is separated from the contacting portion C3 at a certain distance.

Thus, when the automatic paper feeding apparatus 200 starts to send paper from the state of FIG. 6B, the frictional roller 250 will maintain a balance state as in FIG. 4, face the paper-taking roller 230 by the frictional surface S1 and contact the top paper. That is, by moving out the paper tray for replenishing paper, the frictional roller 250 can be switched to different frictional surfaces so that the automatic paper feeding apparatus 200 can proceed with subsequent operation of sending and separating paper. After the automatic paper feeding apparatus 200 of FIG. 3C moves the tray body 220, the frictional roller 250 is rotated clockwise by an angle, and the frictional surface switched to the frictional surface S1 from the frictional surface S6 is incorporated with the paper-taking roller 230 for separating and sending paper. Thus, if the frictional plate used in each frictional surface has a printing capacity of 50,000 sheets of paper, then the automatic paper feeding apparatus 200 has the printing capacity of 300,000 sheets of paper by using the six frictional surfaces S1~S6 in turn, not only incurring no additional cost (the cost of six single frictional plate), but also saving contact time with the supplier of frictional plate and increasing convenience of use.

However, anyone who is skilled in the technology of the invention will understand that the technology of the invention is not limited to the above preferred embodiment. Firstly, the frictional roller is limited to a hexagonal cylinder disclosed in the above embodiment, but rather can be designed as a polygonal cylinder such as a pentagonal or an octagonal cylinder to fit actual needs such as the printing volume of 250,000 or 400,000 sheets of paper. Furthermore, the wiggling device can have different numbers and positions. For example, if the frictional roller is a dumb bell structure and the contacting portions are symmetric and located in the central position, then a single wiggling device can go with the contacting portions. Moreover, in the above embodiment, both the distribution of the contacting portions on the bottom surface of the frictional roller and the initial position of the wiggling device can be viewed as relative distances between the frictional roller, the wiggling device and the paper-taking roller or the angle of the paper track and adjusted accordingly. For example, each contacting portion can correspond to the central part of the flange of each lateral surface instead of the junction between two lateral surfaces.

The automatic paper feeding apparatus disclosed in the above embodiment of the invention increased printing volume by the design of the frictional roller having several frictional surfaces. By moving out the paper for replenishing paper, the user can rotate the frictional roller to different frictional surfaces for the automatic paper feeding apparatus to proceed with subsequent processing of separating and sending paper. The automatic paper feeding apparatus can achieve high printing volume with a simple structure without incurring additional cost.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An automatic paper feeding apparatus used in an electronic apparatus, wherein the automatic paper feeding apparatus comprises:

a tray frame;

a tray body for containing a plurality of sheets of top paper, wherein the tray body can move into and out from the tray frame;

a paper-taking roller disposed on the tray frame, wherein the paper-taking roller moves the top paper in a rotating direction;

at least a wiggling device disposed on the tray frame, wherein the wiggling device wiggles toward the paper-taking roller from an initial position; and a frictional roller disposed on the tray body, wherein the frictional roller has a plurality of frictional surfaces and contacting portions;

wherein, when the tray body lies within the tray frame, the frictional roller is located between the wiggling device and the paper-taking roller, and when the paper-taking roller moves the top paper, one of the contacting portions of the frictional roller leans against the wiggling device situated at the initial position in the direction from the paper-taking roller to the wiggling device such that the frictional roller faces the paper-taking roller and contacts the top paper by the same frictional surface;

when the tray body moves out the tray frame, the wiggling device situated at the initial position moves the contacting portion in the direction from the wiggling device to the paper-taking roller such that the frictional roller rotates and causes the other frictional surface of the frictional roller to face the paper-taking roller substantially;

when the tray body moves into the tray frame, the wiggling device contacting the other contacting portion of the frictional roller wiggles toward the paper-taking roller from the initial position and wiggles back to the initial position until another frictional surface is close with the paper-taking roller.

2. The automatic paper feeding apparatus according to claim 1, wherein the frictional roller is a polygonal cylinder having a plurality of lateral surfaces and two opposite bottom surfaces, the frictional surfaces respectively correspond to the lateral surfaces, and the contacting portions are respectively located on the two bottom surface.

3. The automatic paper feeding apparatus according to claim 2, wherein the number of the contacting portions located on each bottom surface is equal to the number of the lateral surfaces.

4. The automatic paper feeding apparatus according to claim 3, wherein each contacting portion corresponds to the junction between two lateral surfaces.

5. The automatic paper feeding apparatus according to claim 2, wherein the frictional roller is a pentagonal cylinder, a hexagonal cylinder or an octagonal cylinder.

6. The automatic paper feeding apparatus according to claim 2, comprising two wiggling devices respectively corresponding to the two bottom surfaces.

7. The automatic paper feeding apparatus according to claim 1, further comprising two elastic members disposed on the tray body, wherein the frictional roller is pivotally connected between the two elastic members.

8. The automatic paper feeding apparatus according to claim 1, wherein the frictional coefficient between the surface of the paper-taking roller and each top paper is larger than that between each frictional surface and each top paper, and the frictional coefficient between each frictional surface and each top paper is larger than that between two top papers.

9. The automatic paper feeding apparatus according to claim 1, wherein the electronic apparatus is a printer, a facsimile machine, a scanner or a copier.

* * * * *